US008081059B2

(12) United States Patent
Tanimura et al.

(10) Patent No.: US 8,081,059 B2
(45) Date of Patent: Dec. 20, 2011

(54) CHIP RESISTOR AND MANUFACTURING METHOD THEREOF

(75) Inventors: Masanori Tanimura, Kyoto (JP); Torayuki Tsukada, Kyoto (JP); Kousaku Tanaka, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 12/692,827

(22) Filed: Jan. 25, 2010

(65) Prior Publication Data

US 2010/0117783 A1 May 13, 2010

Related U.S. Application Data

(62) Division of application No. 10/593,674, filed as application No. PCT/JP2005/005190 on Mar. 23, 2005, now Pat. No. 7,667,568.

(30) Foreign Application Priority Data

Mar. 24, 2004 (JP) ..... 2004-086752

(51) Int. Cl.
*H01C 1/012* (2006.01)

(52) U.S. Cl. ..... 338/309; 338/307

(58) Field of Classification Search ..... 338/307–309, 338/206, 313, 332–334
See application file for complete search history.

(56) References Cited

U.S. PATENT DOCUMENTS

| | | | | |
|---|---|---|---|---|
| 4,706,060 | A * | 11/1987 | May | 338/20 |
| 4,792,781 | A | 12/1988 | Takahashi et al. | |
| 5,339,068 | A * | 8/1994 | Tsunoda et al. | 338/332 |
| 5,691,690 | A | 11/1997 | Minato et al. | |
| 5,990,781 | A | 11/1999 | Kambara | |
| 6,005,474 | A | 12/1999 | Takeuchi et al. | |
| 6,314,637 | B1 * | 11/2001 | Kimura et al. | 29/620 |
| 6,356,184 | B1 | 3/2002 | Doi et al. | |
| 6,724,295 | B2 * | 4/2004 | Tsukada | 338/309 |
| 6,801,118 | B1 | 10/2004 | Ikemoto et al. | |
| 6,856,234 | B2 * | 2/2005 | Kuriyama et al. | 338/309 |
| 7,042,330 | B2 | 5/2006 | Nakamura et al. | |
| 7,612,429 | B2 * | 11/2009 | Tsukada et al. | 257/536 |
| 2005/0035844 | A1 | 2/2005 | Tsukada | |
| 2005/0266615 | A1 | 12/2005 | Tsukada | |
| 2006/0097340 | A1 | 5/2006 | Tsukda et al. | |

FOREIGN PATENT DOCUMENTS

| | | | |
|---|---|---|---|
| JP | 47-27876 | | 8/1972 |
| JP | 7-29704 | | 1/1995 |
| JP | 2000-114009 | | 4/2000 |
| JP | 2002-057009 | * | 2/2002 |
| JP | 2002-184601 | | 6/2002 |
| JP | 2004-63503 | | 2/2004 |
| JP | 2004-153160 | | 5/2004 |
| JP | 2004-327906 | | 11/2004 |
| JP | 2005-072268 | | 3/2005 |
| WO | WO 99/18584 | | 4/1999 |
| WO | WO 2004/010440 | | 1/2004 |

* cited by examiner

*Primary Examiner* — Kyung Lee
(74) *Attorney, Agent, or Firm* — Hamre, Schumann, Mueller & Larson, P.C.

(57) ABSTRACT

A chip resistor (A1) includes a chip-like resistor element (1), two electrodes (31) spaced from each other on the bottom surface (1*a*) of the resistor element, and an insulation film (21) between the two electrodes. Each electrode (31) has an overlapping portion (31*c*) which overlaps the insulation film (21) as viewed in the vertical direction.

8 Claims, 11 Drawing Sheets

CHIP RESISTOR AND MANUFACTURING METHOD THEREOF

CROSS REFERENCE TO RELATED APPLICATIONS

This application is a Division of U.S. Ser. No. 10/593,674, filed Sep. 21, 2006, which is a U.S. National Stage application of International No. PCT/JP2005/005190 filed Mar. 23, 2005, which is incorporated herein by reference.

FIELD OF THE INVENTION

The present invention relates to a chip resistor and a method of making the same.

BACKGROUND ART

FIG. 15 of the present application shows a chip resistor disclosed in Patent Document 1 below. The disclosed chip resistor B includes a metal resistor element 90 and a pair of electrodes 91 fixed to the bottom surface 90*a* of the resistor element. The electrodes 91 are spaced from each other by a predetermined distance s5. Each of the electrodes 91 has its lower surface formed with a solder layer 92.

Patent Document 1: JP-A-2002-57009

When the size of the resistor element 90 is unchanged, the resistance of the chip resistor B is in proportion to the distance s5 between the electrodes 91. Thus, the resistance of the chip resistor B is changed by varying the distance s5. As understood from FIG. 15, to increase the distance s5 decreases the width s6 of each electrode 91, and to decrease the distance s5 increases the width s6.

As described above, in the conventional chip resistor B, the change of the distance s5 affects the width s6, which gives rise to the following problem.

In use, the chip resistor B is soldered to a circuit board, for example. At this stage, each electrode 91 of the resistor B should be properly bonded, electrically and mechanically, to the relevant connection terminal formed on the circuit board. To achieve this, the size of the connection terminal matches the size of the electrode 91. With the conventional design described above, however, the size of the connection terminal needs to be changed every time the resistance of the chip resistor B is changed. Unfavorably, this lowers the productivity of circuit boards and increases the production costs.

DISCLOSURE OF THE INVENTION

The present invention has been proposed under the circumstances described above. It is an object of the present invention to provide a chip resistor whose electrode size remain unchanged even when its resistance is varied. Another object of the present invention is to provide a method of making such a chip resistor efficiently and appropriately.

A chip resistor provided by a first aspect of the present invention includes: a chip-like resistor element which has a bottom surface, an upper surface opposite to the bottom surface, two end surfaces and two side surfaces; two electrodes spaced from each other on the bottom surface of the resistor element; and an insulator between the two electrodes. At least one of the two electrodes overlaps the insulator as viewed in a direction in which the bottom surface and the upper surface are spaced from each other.

Preferably, the insulator is provided by a resin film which is flat as a whole, and the above-mentioned at least one of the electrodes includes an overlapping portion extending onto the resin film. Alternatively, the insulator includes a first portion between the two electrodes, and a second portion formed integral with the first portion, and the second portion extends on the above-mentioned at least one of the electrodes.

Preferably, the chip resistor further includes a soldering-facilitation layer which covers the end surfaces of the resistor element and the electrodes.

Preferably, the chip resistor further includes an additional insulation film formed on the upper surface of the resistor element, and two auxiliary electrodes spaced from each other via the additional insulation film.

A method of making a chip resistor provided by a second aspect of the present invention includes the steps of: patterning an insulation film on a surface of a metal resistor element; forming a conductive layer on the surface of the resistor element to extend on both the insulation film and a region at which the insulation film is not present; and dividing the resistor element into a plurality of chips so that part of the conductive layer is formed into a pair of electrodes spaced from each other via part of the insulation film.

Preferably, the resistor element is either a metal plate or a metal bar.

Preferably, the step of forming a conductive layer includes: a printing process of forming a first conductive layer extending on both the insulation film and the region at which the insulation film is not present; and a plating process of forming a second conductive layer on the first conductive layer.

Preferably, the patterning of the insulation film is performed by thick-film printing.

A method of making a chip resistor according to a third aspect of the present invention includes the steps of: patterning a first insulation film on a surface of a metal resistor element; forming a conductive layer on a region of the surface of the resistor element in which the insulation film is not present; patterning a second insulation film on the surface of the resistor element so that the second film extends on both the first insulation film and the conductive layer; and dividing the resistor element into a plurality of chips so that part of the conductive layer is formed into a pair of electrodes spaced from each other via part of the first insulation film.

Preferably, the patterning of the first insulation film and the second insulation film is performed by thick-film printing.

Preferably, the conductive layer is formed by plating.

Other characteristics and advantages of the present invention will become clearer from the following detailed description to be made with reference to the attached drawings.

BEST MODE FOR CARRYING OUT THE INVENTION

Preferred embodiments of the present invention will be described below with reference to the drawings.

FIG. 1 through FIG. 4 show a chip resistor according to a first embodiment of the present invention. The chip resistor A1 includes a resistor element 1, insulation films 21-23, a pair of lower electrodes 31, a pair of upper electrodes (auxiliary electrodes) 33, and a pair of plated layers 4 (not illustrated in FIG. 4) to facilitate soldering. The chip resistor A1 has a low resistance of 0.5 mΩ~100 mΩ for example. It should be noted, however, that this range of resistance is nothing more than an example, and the scope of the present invention is not limited to resistors which have such a low resistance.

Figure 1:
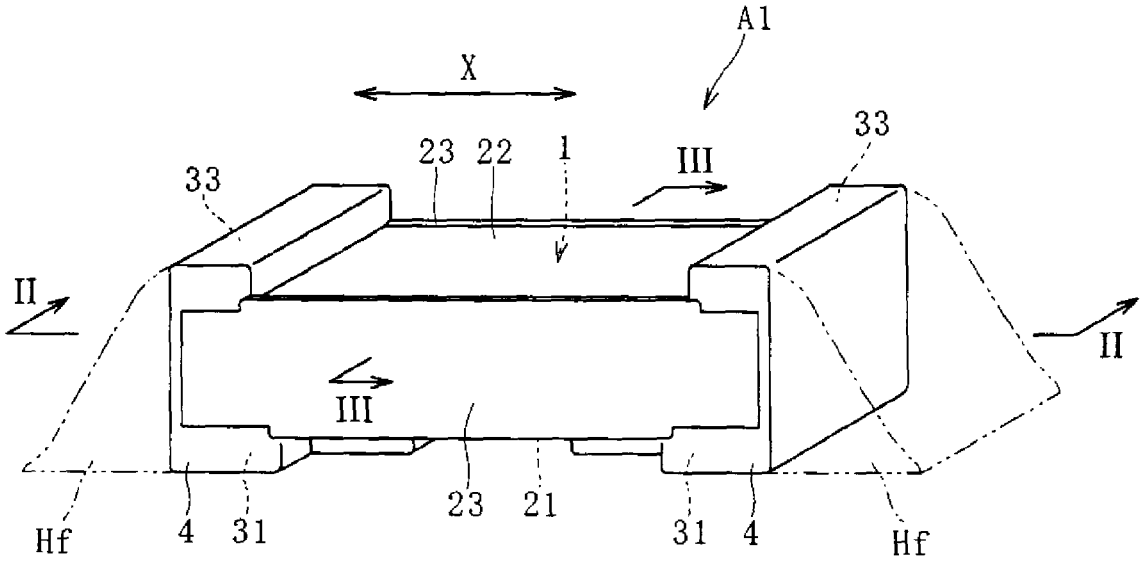
FIG. 1 is a perspective view showing a chip resistor according to a first embodiment of the present invention.
Figure 2:
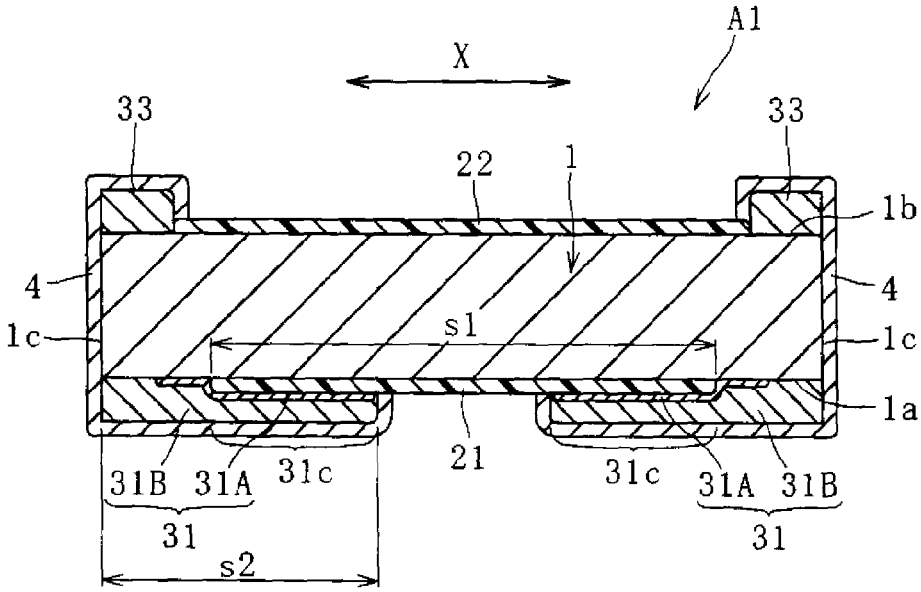
FIG. 2 is a sectional view taken along lines in FIG. 1.
Figure 3:
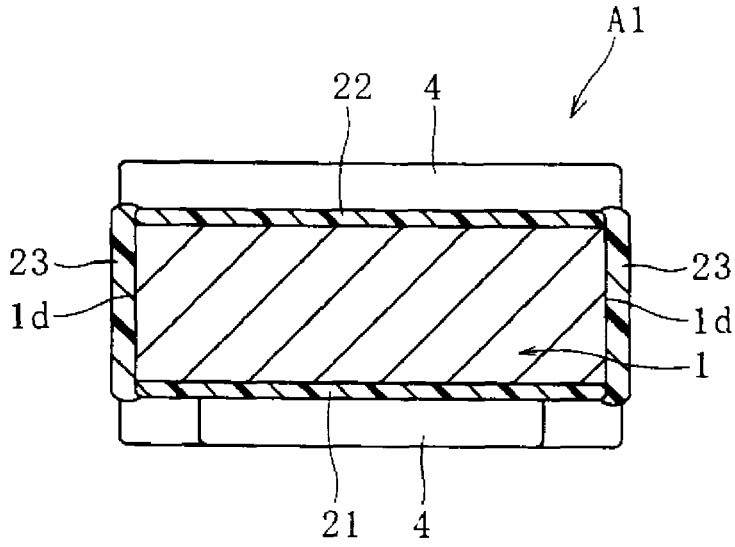
FIG. 3 is a sectional view taken along lines III-III in FIG. 1.

The resistor element 1 is a chip which has a uniform thickness and a rectangular plan view, and as shown in FIG. 2 or FIG. 3, has a bottom surface 1*a*, an upper surface 1*b*, two end surfaces 1*c* (spaced from each other in the direction X) and two side surfaces 1*d* (longitudinal in the direction X). The resistor element 1 is made of a Ni—Cu alloy or a Cu—Mn alloy for example. It should be noted that the present invention is not limited by these examples. The resistor element 1 may be made of other materials which have an appropriate resistivity for a target resistance.

Each of the insulation films 21-23 is made of an epoxy resin for example. The insulation film 21 covers a region between the two lower electrodes 31 on the bottom surface 1*a* of the resistor element 1. The insulation film 22 covers a region between the two auxiliary electrodes 33 on the upper surface 1*b* of the resistor element 1. The insulation film 23 covers all of the side surfaces 1*d* of the resistor element 1.

Figure 4:
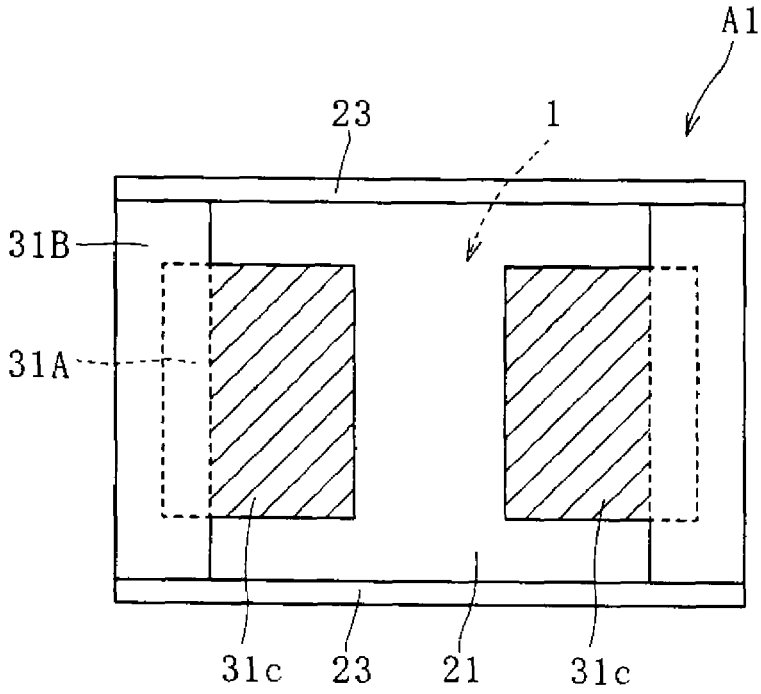
FIG. 4 is a bottom view of the chip resistor according to the first embodiment.

The lower electrodes 31 are formed on the bottom surface 1*a* of the resistor element 1, spaced from each other in the direction X. As shown in FIG. 2, each of the electrodes 31 has a two-layer structure consisting of a first conductive layer 31A and a second conductive layer 31B formed on the first layer. As understood from FIG. 2 and FIG. 4, each electrode 31 covers part of the bottom surface 1*a* of the resistor element 1 (the region not covered by the insulation film 21) and part of the insulation film 21. A portion of each electrode 31 which overlaps the insulation film 21 will hereinafter be called "overlapping portion (indicated by a sign 31*c*)". In FIG. 4, hatched areas are the overlapping portions 31*c*.

The auxiliary electrodes 33 are spaced from each other on the upper surface 1*b* of the resistor element 1, with the insulation film 22 in between. The auxiliary electrodes 33 are made of the same material as that of the second conductive layer 31B of the lower electrode 31, and are formed by e.g. copper plating.

As shown in FIG. 2, the plated layers 4 cover the lower electrodes 31, the auxiliary electrodes 33 and the end surfaces 1*c* of the resistor element 1, as an integrally formed layer. The plated layers 4 are made of e.g. Sn, and may be made of other materials.

The resistor element 1 has a thickness of e.g. 0.1 mm through 1 mm. The lower electrodes 31 and the auxiliary electrodes 33 have a thickness of e.g. 30 through 100 μm. Each of the insulation films 21-23 has a thickness of e.g. 20 μm, and the plated layers 4 have a thickness of e.g. 5 μm. The resistor element 1 has a length and a width of e.g. 2 through 7 mm. Obviously, the sizes of the resistor element 1 are not limited to the dimensions exemplified above, and may be selected as appropriately in light of the desired resistance.

Next, a method of manufacturing the chip resistor A1 will be described with reference to FIG. 5 through FIG. 8.

Figure 5A:
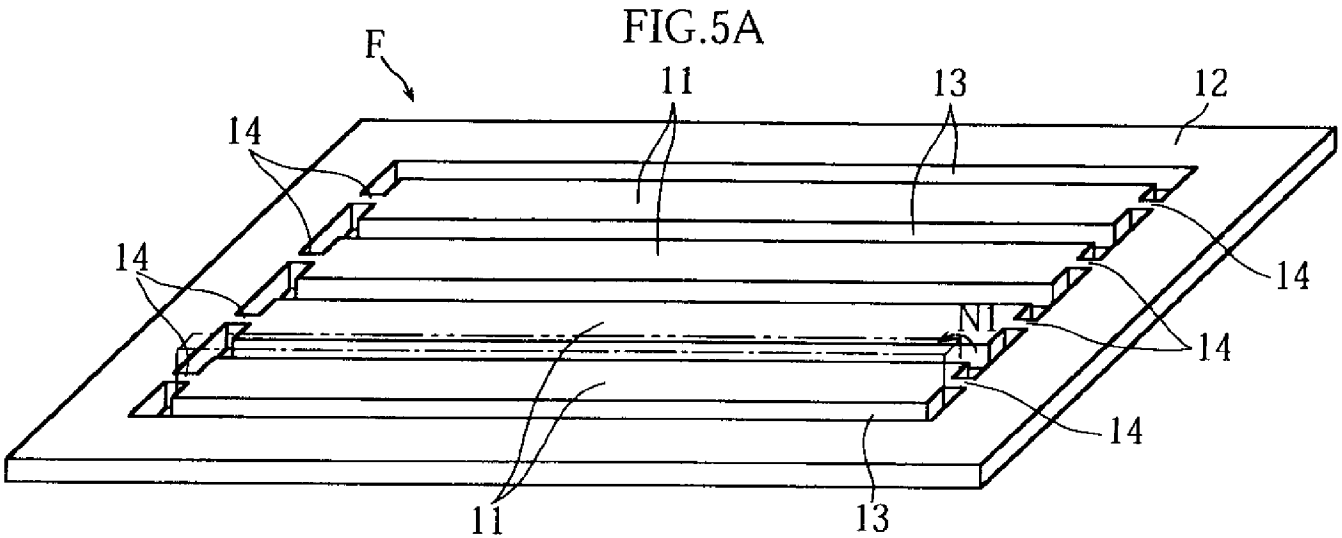
FIG. 5A is a perspective view showing a frame used in manufacture of a chip resistor according to the present invention.
Figure 5B:
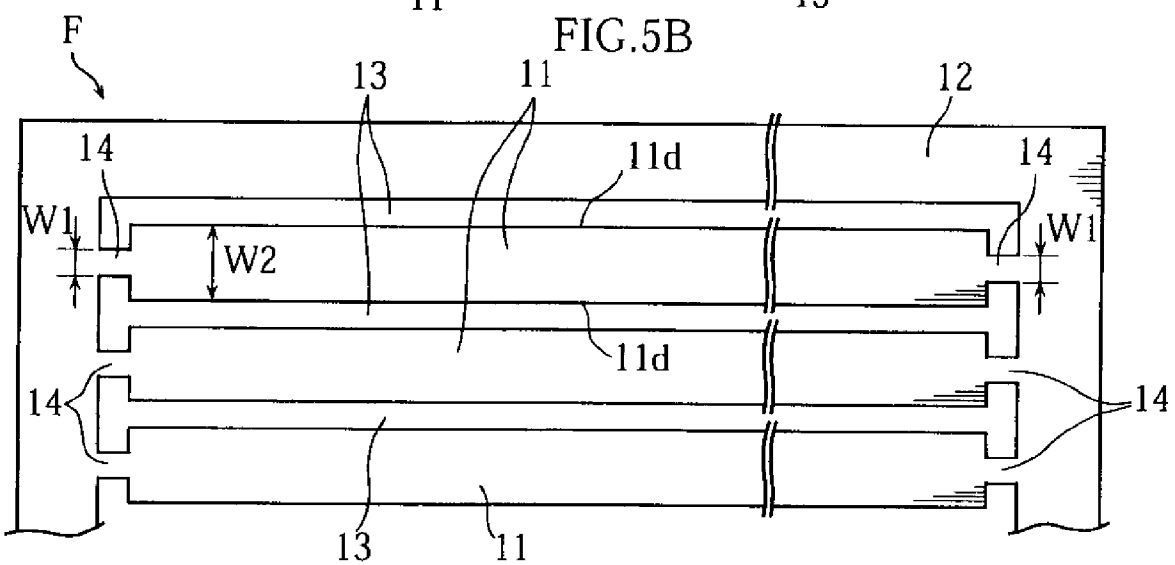
FIG. 5B is a plan view showing a primary portion of the frame.

First, a frame from which resistor elements 1 are to be made is prepared. FIG. 5A shows such a frame F prepared by e.g. punching a metal sheet of a uniform thickness. The frame F includes a plurality of bars 11 which extend in parallel to each other, and a rectangular support 12 which supports these bars 11. Mutually adjacent bars 11 are spaced from each other by a slit 13. Each bar 11 has two connection tabs 14, each of which is formed at a longitudinal end of the bar, and connects the bar with the support 12. As shown in FIG. 5B, each connection tab 14 has a width W1 which is smaller than a width W2 of the bar 11. Therefore, the connection tabs 14 can easily be twisted to rotate the bar 11 about its longitudinal axis. FIG. 5A shows an instance in which one of the bars 11 is rotated by 90 degrees in the direction indicated by Arrow N1. Rotating the bar 11 in such a way makes it easy to perform the step of forming the insulation film 23 (to be described later) on the side surfaces 11*d* of the bar 11.

Figure 6A:
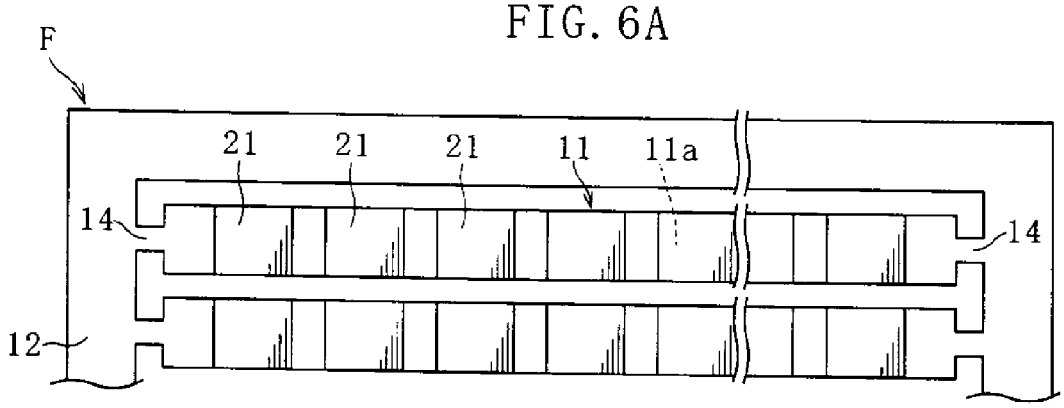
FIG. 6A and FIG. 6B are plan views showing a step of manufacturing the chip resistor according to the first embodiment.
Figure 6B:
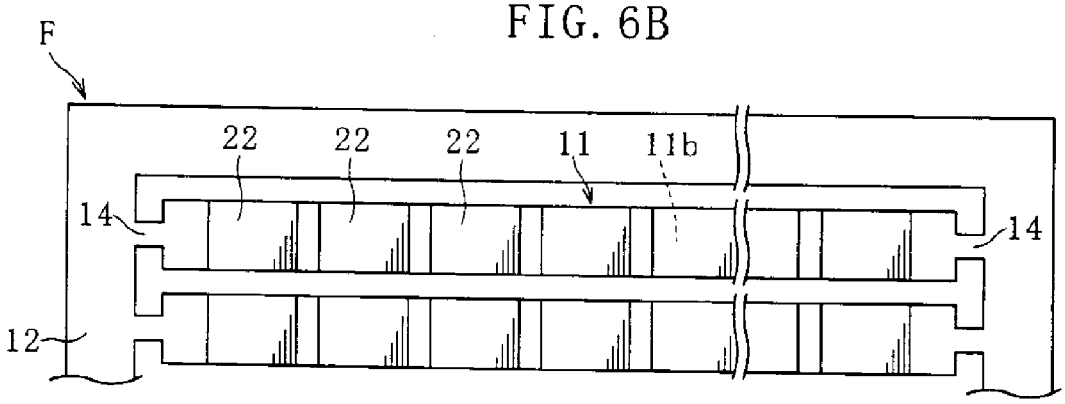

After preparing the frame F, plural pieces of a rectangular insulation film are formed on a first surface 11*a* (e.g. an upper surface as in FIG. 5) in each bar 11 and on the surface away therefrom, i.e. a second surface 11*b* (a lower surface as in FIG. 5). Specifically, as shown in FIG. 6A, plural pieces of an insulation film 21 are formed on all of the first surfaces 11*a* of the bars 11 so that the film pieces are spaced from each other in the longitudinal direction of the bar. Likewise, as shown in FIG. 6B, plural pieces of an insulation film 22 are formed on all of the second surfaces 11*b* of the bars 11 so that the film pieces are spaced from each other in the longitudinal direction of the bar. Each of the insulation films 21, 22 is formed of the same material (an epoxy resin for example) by thick-film printing. Thick-film printing methods serve to form the pieces of insulation films 21, 22 precisely to the desired dimensions. Surfaces of the insulation films 22 may have printed marks and symbols indicating characteristics of the resistor.

Figure 7:
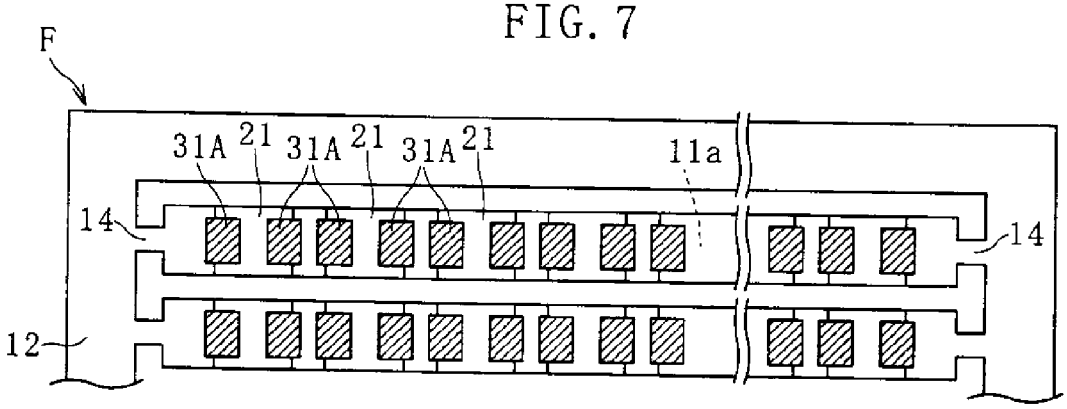
FIG. 7 is a plan view showing another step of the manufacturing process.

Next, as shown in FIG. 7, plural pieces of a rectangular conductive layer 31A are formed on all of the first surfaces 11*a* of the bars 11 so that the film pieces are spaced from each other in the longitudinal direction of the bar. Each piece of the conductive layer 31A is formed to overlap a region where there is no insulation film 21 formed and a region formed with an insulation film 21. The region not formed with the insulation film 21 includes a region where the conductive layer 31A is not formed yet. In this particular region which is not formed with the conductive layer, the original surface of the bar is exposed. A plating process to be described later causes the conductive layer 31B to form directly upon this particular region where there is no conductive layer, establishing the reliable bond of the conductive layer 31B to the bar 11. The formation process of the conductive layer 31A includes a step of printing using a paste which contains a metal powder provided primarily by e.g. silver. According to such a printing technique, it is easy to form the conductive layer 31A accurately to the desired dimensions.

Figure 8A:
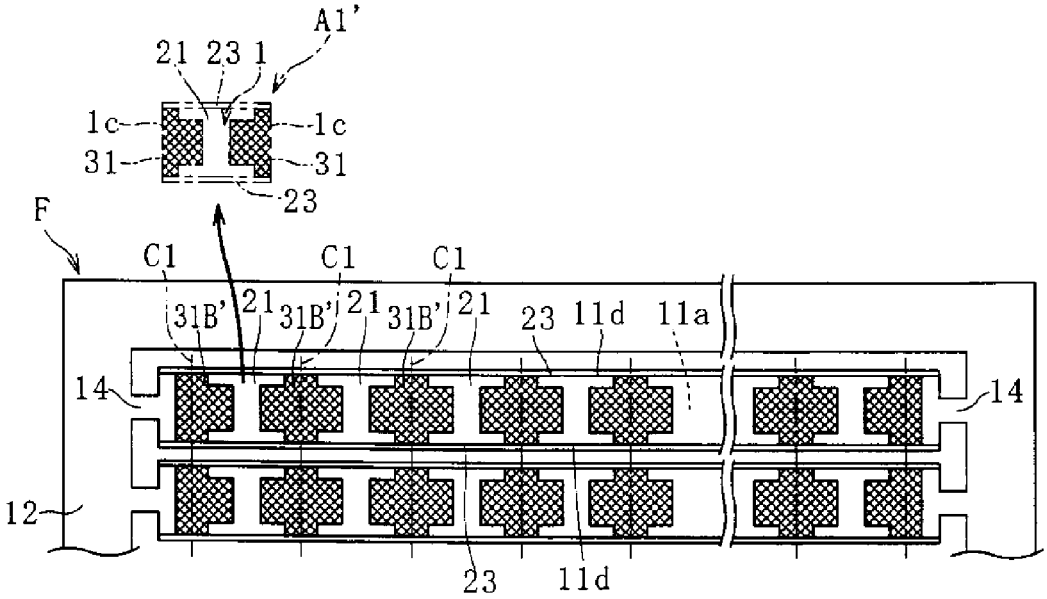
FIG. 8A and FIG. 8B are plan views showing another step of the manufacturing process.

Next, an insulation film 21 is formed on each of the side surfaces 11*d* of all the bars 11 (See FIG. 8A). The formation of the insulation film 23 is made with the same material as used in the formation of the insulation films 21, 22. To form the insulation film 23 on the side surfaces 11*d*, each bar 11 is first rotated to an attitude drawn in the phantom lines in FIG. 5A. Then, side surfaces 11*d* are dipped in the coating liquid to apply the coating material on the side surfaces and finally, the coating material is dried on the surfaces.

Figure 8B:
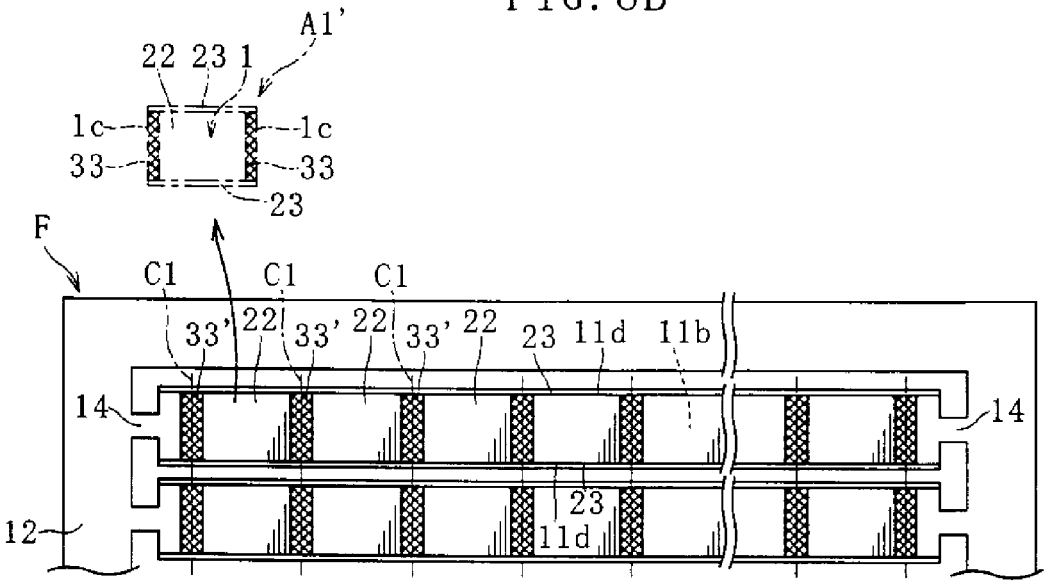

Next, as shown in FIGS. 8A, 8B, copper-plating is performed to make a conductive layer 31B' and a conductive layer 33' on the first surface 11*a* and the second surface 11*b* respectively of each bar 11. More specifically, the conductive layer 31B' is formed as shown in FIG. 8A, on the first surface 11*a* to cover the above-described region where no conductive layer is formed and also to cover the conductive layer 31A (See FIG. 7). Each region covered with the conductive layer 31B' will serve as part of an electrode 31. Similarly, as shown in FIG. 8B, the conductive layer 33' is formed on the second surface 11*b*, to cover the region where no insulation film 22 is formed. Each region covered with the conductive layer 33' will serve as an auxiliary electrode 33.

As described above, the conductive layer 31A is also formed on the insulation film 21. Therefore, it is easy to form the conductive layer 31B' on the insulation film by a plating process. By plating, the conductive layers 31B', 33' are formed simultaneously, with an improved production efficiency compared to the instance where two conductive layers 31B', 33' are formed in separate steps.

After the plating process, each bar 11 is cut along phantom lines C1 as shown in FIGS. 8A, 8B into individual chip resistors A1'. The phantom lines C1 are perpendicular to the longitudinal direction of the bar 11. Further, each phantom line C1 divides pieces covered with the conductive layer 33' equally into two halves. Therefore, each resistor A1' thus obtained includes a pair of lower electrodes 31 and a pair of auxiliary electrodes 33. Since a single frame F produces a plurality of chip resistors A1', the method is highly productive.

Next, a plated layer 4 is formed on each end surface 1*c* of the resistor element 1 in the chip resistor A1', as well as surfaces of each electrode 31 and surfaces of each auxiliary electrode 33. Formation of the plated layers 4 are performed by barrel plating for example. In the barrel plating, a plurality of chip resistors A1' are placed in a single barrel. Each chip resistor A1' has exposed metal surfaces in each end surface 1*c* of the resistor element 1, the surface of each electrode 31 and the surface of each auxiliary electrode 33, while all of the other portions are covered with the insulation films through 23. Therefore, it is possible to form the plated layers 4 efficiently and appropriately only on the metal surfaces described above. Before the formation of plated layers 4, formation of a protective film provided by e.g. Ni may be performed on the metal surfaces, as an under coating for the plated layers 4. Formation of such protection films is preferred since it provides anti-oxidation barriers for the electrodes 31 and the auxiliary electrodes 33. The formation of protective films can also be made by barrel plating. The sequence of steps so far described above enables efficient manufacture of the chip resistors A1 in FIG. 1 through FIG. 4.

In use, chip resistors A1 are surface-mounted onto a circuit board by a solder re-flow process for example. In the solder reflowing, the chip resistors A1 are placed in alignment with the electrically conductive terminals 31 which are formed on the circuit board, and then the substrate and the resistors A1 are heated together in a reflow furnace.

The functions of the chip resistor A1 will be described below.

As shown in FIG. 2, in the above-described chip resistor A1, the overlapping portion 31*c* of each lower electrode 31 rides on the insulation film 21. More specifically, when viewed in a manner such that the line of sight extends in parallel to the vertical direction (in which the bottom surface 1*a* and the upper surface 1*b* are spaced from each other) (or simply "when viewed in the vertical direction"), each lower electrode 31 and the insulation film 21 at least partially overlap with each other. For the left-hand-side electrode 31, the overlapping portion 31*c* extends to the right, from a region ("left-hand-side contact region") where the left-hand-side electrode 31 makes direct contact with the resistor element 1. Likewise, for the right-hand-side electrode 31, the overlapping portion 31*c* extends to the left, from a region ("right-hand-side contact region") where the right-hand-side electrode 31 makes direct contact with the resistor element 1.

According to the above arrangement, the resistance of the chip resistor A1 is determined, not by the shortest distance between the two lower electrodes 31 (i.e. the distance between the two overlapping portions 31*c*), but by the shortest distance between the left-hand-side contact region and the right-hand-side contact region ("resistance determining distance"). On the other hand, according to the manufacturing method which has been described with reference to FIG. 5 through FIG. 8, the resistance determining distance is equal to a dimension s1 of the insulation film 21. This means that by varying the dimension s1 of the insulation film 21, it is possible to vary the resistance determining distance, thereby varying the resistance of the chip resistor A1, without changing the dimension s2 of each lower electrode 31.

As described above, there is no need in the chip resistor A1 to change the dimension s2 of the lower electrode 31 for changing the resistance. Therefore, the size of connection terminals on the circuit board does not need to be changed even when there is a change, for example, in the electric circuit specifications which requires a change in the resistance of the chip resistor A1 to be mounted on the circuit board. Further, when a plurality of chip resistors A1 of different resistances are to be mounted on a single circuit board, all the connection terminals for the resistors A1 can be of the same size.

According to the chip resistor A1, the dimension s1 of the insulation film 21 can be varied over a wider range if a greater initial value is given to the dimension s2 of each lower electrode 31, resulting in a wider adjustment range of the resistance of resistor A1. Also, the greater the dimension s2 of the electrode 31, the more efficient heat radiation will be achieved from the electrically heated resistor element 1 through the electrode 31. Further, the greater the dimension s2 of the electrode 31, the greater the area of solder bonding in the electrode 31, leading to increased bonding strength to the circuit board.

The chip resistor A1 also has the following technical advantages. Specifically, when solder reflowing is used to mount the resistor A1 on a circuit board, the plated layers 4 will melt. As described above, the plated layer 4 is formed on the end surfaces 1*c* of the resistor element and on the auxiliary electrodes 33. Thus, the solder reflowing will form solder fillets Hf as shown in phantom lines in FIG. 1. Therefore, simple visual inspection to the shape of solder fillets Hf will tell whether the chip resistor A1 is appropriately mounted or not. In addition, formation of the solder fillets Hf helps increase bonding strength of the chip resistor A1 to the circuit board.

The pair of auxiliary electrodes 33 serve to release the heat generated by the electricity which passes through the resistor element 1, increasing heat radiation effect. In addition, the auxiliary electrodes 33 may be used as follows. The pair of electrodes 31 is used for supplying electric current whereas the pair of auxiliary electrodes is used for voltage measurement. When detecting an electric current in the circuit, a resistor A1 (whose resistance is given) is connected in series to the circuit via a pair of current supplying electrodes (electrodes 31), whereas a pair of voltage measurement electrodes (auxiliary electrodes 33) are connected with a voltmeter. Under such a configuration, voltage drop in the resistor element 1 of the chip resistor A1 is measured with the voltmeter. From the measured voltage value and the known resistance of the resistor A1, the value of electric current which passes through the resistor element 1 can be obtained by using the Ohm's Law.

Since the insulation film 21 is formed by thick-film printing, highly accurate formation to predetermined target sizes is possible. This enables to decrease errors in setting the resistance which is dependent on the accuracy of the dimension s1 of the insulation film 21.

Figure 9:
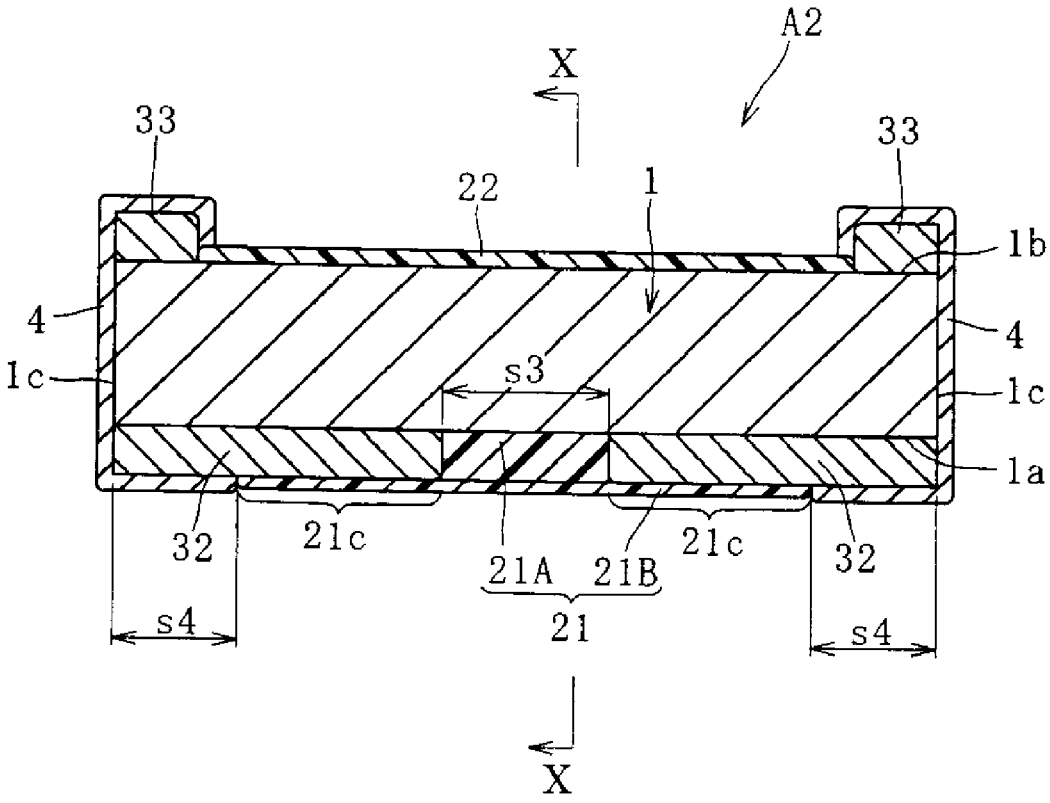
FIG. 9 is a sectional view showing a chip resistor according to a second embodiment of the present invention.
Figure 10:
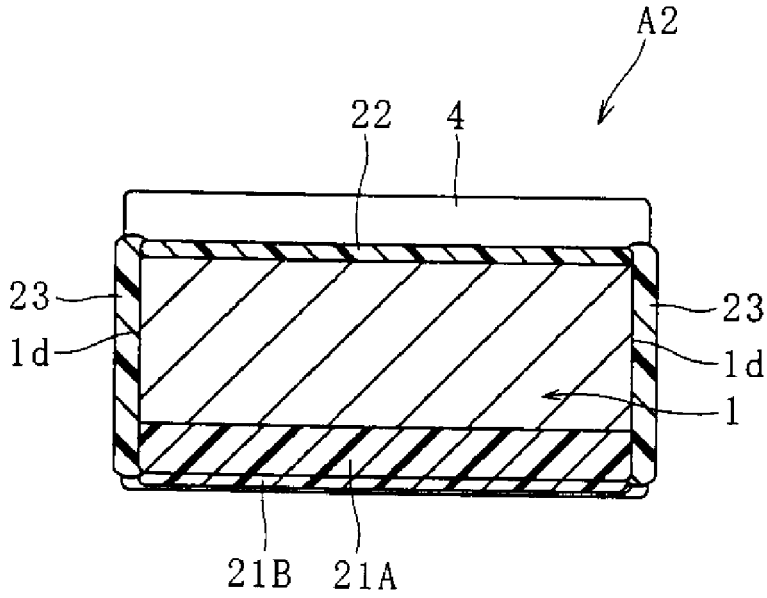
FIG. 10 is a sectional view taken along lines X-X in FIG. 9.

FIG. 9 and FIG. 10 show a chip resistor A2 according to a second embodiment of the present invention. It should be noted that in the following embodiments, elements which are identical or similar to those in the first embodiment will be indicated by the same reference signs.

The chip resistor A2 includes a resistor element 1, insulation films 21-23, a pair of lower electrodes 32, a pair of auxiliary electrodes 33 and a pair of plated layers 4. The lower electrodes 32 are spaced from each other by a predetermined distance ("resistance determining distance"). Each electrode 32 covers a region not formed with the insulation film 21 in a bottom surface 1 of the resistor element 1, so as not to ride on the insulation film 21. The insulation film 21 consists of a first insulation layer 21A and a second insulation layer 21B which is formed on the first insulation layer. The first and the second insulation layers 21A, 21B are formed of the same resin material as will be described later, so the insulation film 21 can be considered as a single element.

As shown in FIG. 9, the first insulation layer 21A is formed between the lower electrodes 32. The second insulation layer 21B has overlapping portions 21*c* partially masking both the electrodes 32. Thus, when viewed in the vertical direction, the insulation film 21 at least partially overlaps with each of the electrodes 32.

A method of manufacturing the chip resistor A2 will be described with reference to FIG. 11 through FIG. 13.

Figure 11A:
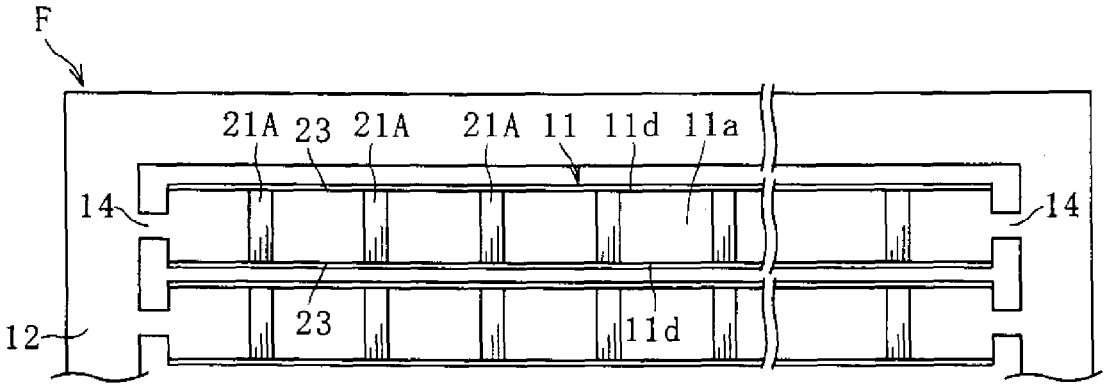
FIG. 11A and FIG. 11B are plan views showing a step of manufacturing the chip resistor according to the second embodiment.
Figure 11B:
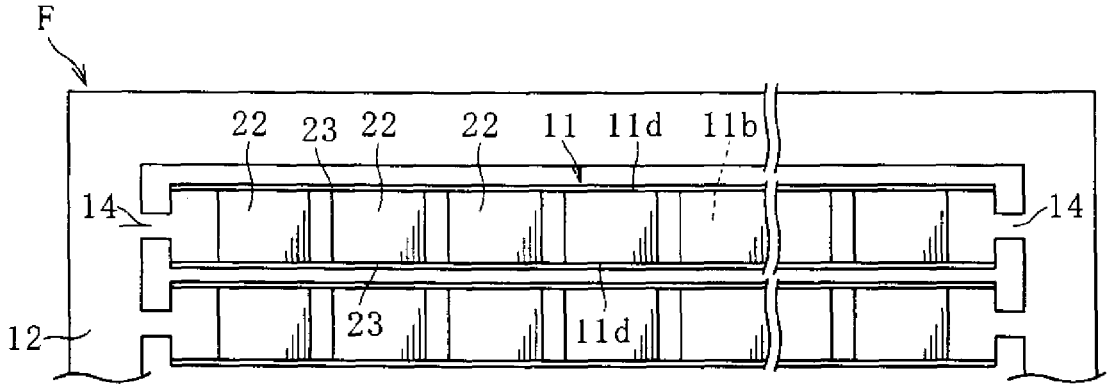

First, a frame F which is like the one as used in the first embodiment is prepared. Next, as shown in FIGS. 11A and 11B, a plurality of rectangular pieces of an insulation layer 21A (FIG. 11A) and a plurality of rectangular pieces of an insulation film 22 (FIG. 11B) are formed on a first surface 11*a* and on a second surface 11*b* in each bar 11. The insulation layer 21A and the insulation film 22 is made of the same material such as epoxy resin applied by a thick-film printing method. Advantageously, thick-film printing makes it possible to form the insulation layer 21A and the insulation film 22 precisely to the desired width and thickness.

Then, an insulation film 23 is formed on all the side surfaces 11*d* of each bar 11. The insulation film 23 is made of the same material as that used for making the insulation layer 21A and the insulation film 22. The insulation film 23 may be formed by the same method as used in the formation of the insulation film 23 in the embodiment 1.

Figure 12A:
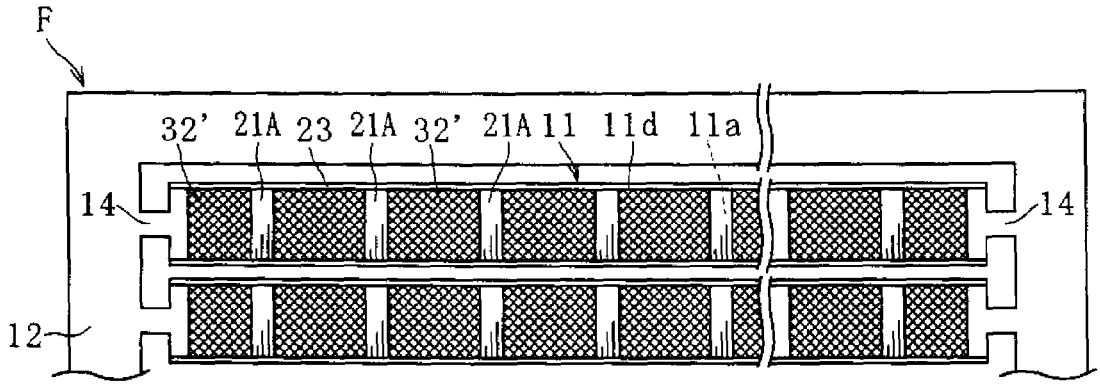
FIG. 12A and FIG. 12B are plan views showing another step of manufacturing the chip resistor according to the second embodiment.
Figure 12B:
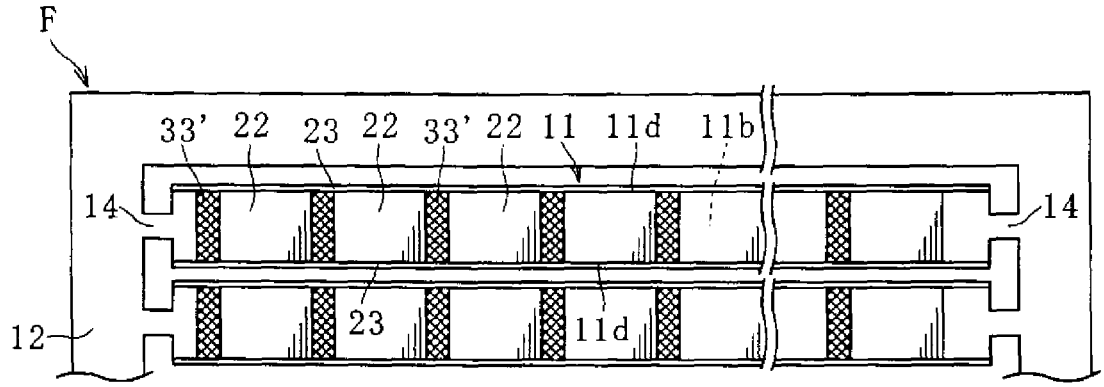

Next, as shown in FIGS. 12A and 12B, plural pieces of a conductive layer 31B' and a plural pieces of a conductive layer 33' are formed (each indicated by cross-hatching) on the first surface 11*a* and the second surface 11*b* of each bar 11 where the insulation layer 21A and the insulation film 22 are not present. Each region on the first surface 11*a* covered by the conductive layer 32' will provide a lower electrode 32 and each region on the second surface 11*b* covered by the conductive layer 33' will provide an auxiliary electrode 33. The conductive layers 32', 33' may be formed by copper plating for example.

Figure 13A:
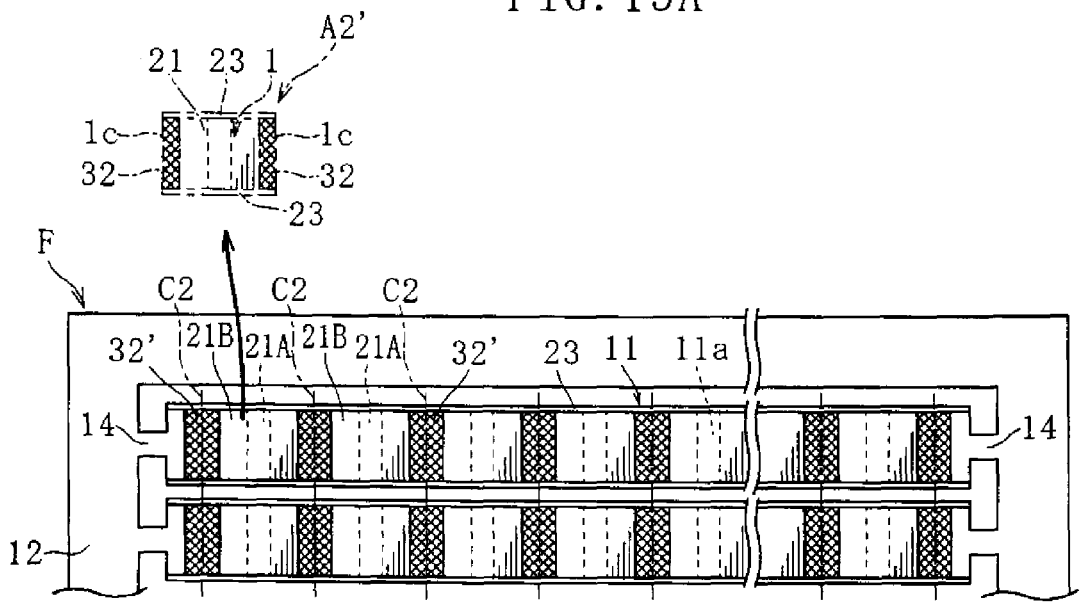
FIG. 13A and FIG. 13B are plan views showing another step of manufacturing the chip resistor according to the second embodiment.

As shown in FIG. 13A, plural pieces of a second insulation layers 21B which are rectangular are formed on the first surface of each bar 11. Each piece of the second insulation layer 21B covers a piece of the first insulation layer 21A, while also overlapping the two abutting conductive layers 32' on both sides. The formation of the second insulation layer 21B is made by thick-film printing using the same material as that used for the first insulation layer 21A and the insulation films 22, 23.

Figure 13B:
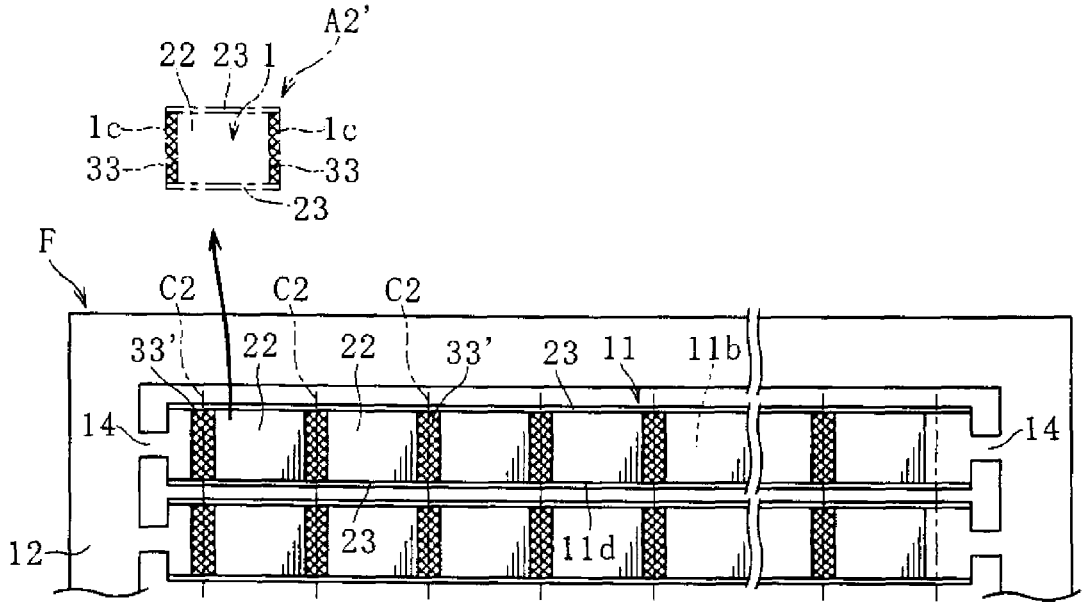

After the formation of the second insulation layer 21B, each bar 11 is cut as shown in FIGS. 13A and 13B into individual chip resistors A2'. In this cutting process, each bar 11 is cut at phantom lines C2 so that each resulting piece contains the first and the second insulation layers 21A, 21B abutted by parts of the conductive layer 32' from both sides. Each phantom line C2 divides a set of the conductive layers 32', 33' into two equal halves in a direction perpendicular to the longitudinal direction of the bars 11. In this process therefore, the chip resistor A2' is formed with a pair of lower electrodes 32 and a pair of auxiliary electrodes 33. Then, a plated layer 4 is formed by barrel plating process, on each end surface is of the chip resistor A2', surfaces of each lower electrode 32 and surfaces of each auxiliary electrode 33. According to the above-described steps, efficient production of the chip resistor A2 shown in FIGS. 9 and 10 is possible.

Next, functions of the chip resistor A2 will be described.

As shown in FIG. 9, the resistance of the chip resistor A2 is determined by a dimension s3 of the first insulation layer 21A. By varying the dimension s3, the resistance of the chip resistor A2 can be varied. Further, according to the chip resistor A2, the second insulation layer 21B has its overlapping portions 21*c* which overlap the lower electrodes 32. Therefore, even when the dimension s3 of the insulation layer 21A is changed in order to change the resistance, it is possible to maintain the dimension s4, i.e. the dimension of the exposed portion of the electrode 32. Therefore, the same technical advantages as achieved by the first embodiment are enjoyed.

Figure 14A:
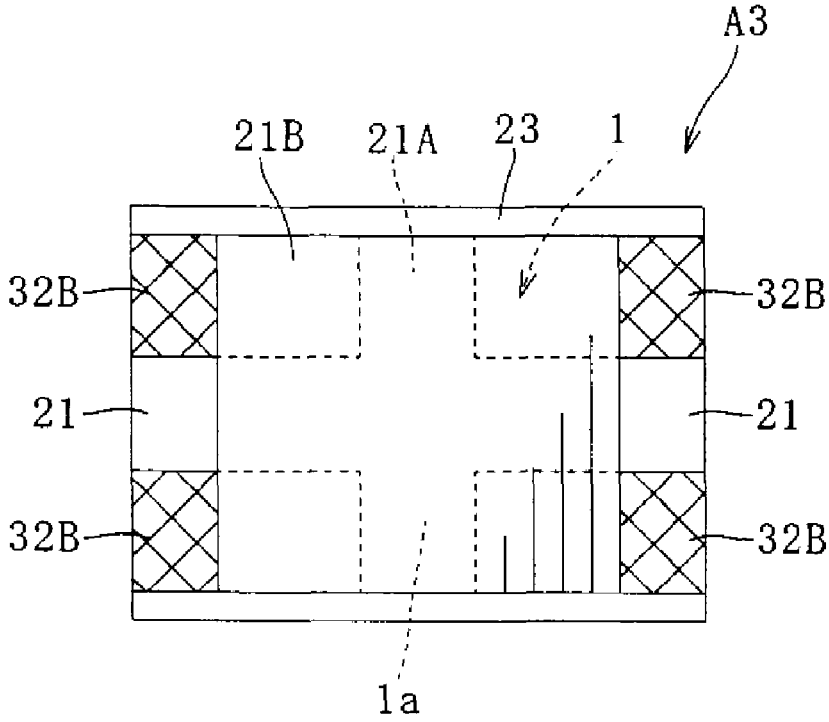
FIG. 14A is a bottom view showing a chip resistor according to a third embodiment of the present invention.
Figure 14B:
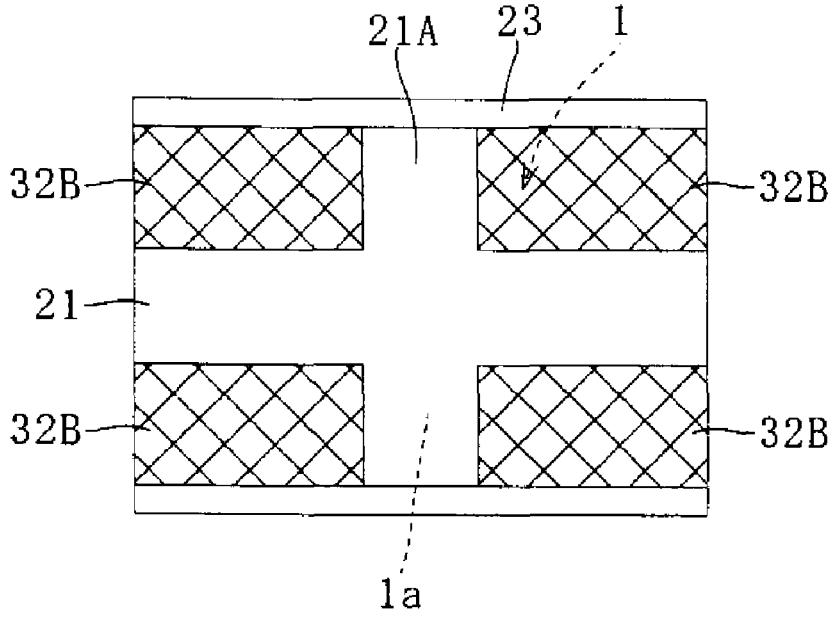
FIG. 14B shows the chip resistor in a manufacturing process.
Figure 15:
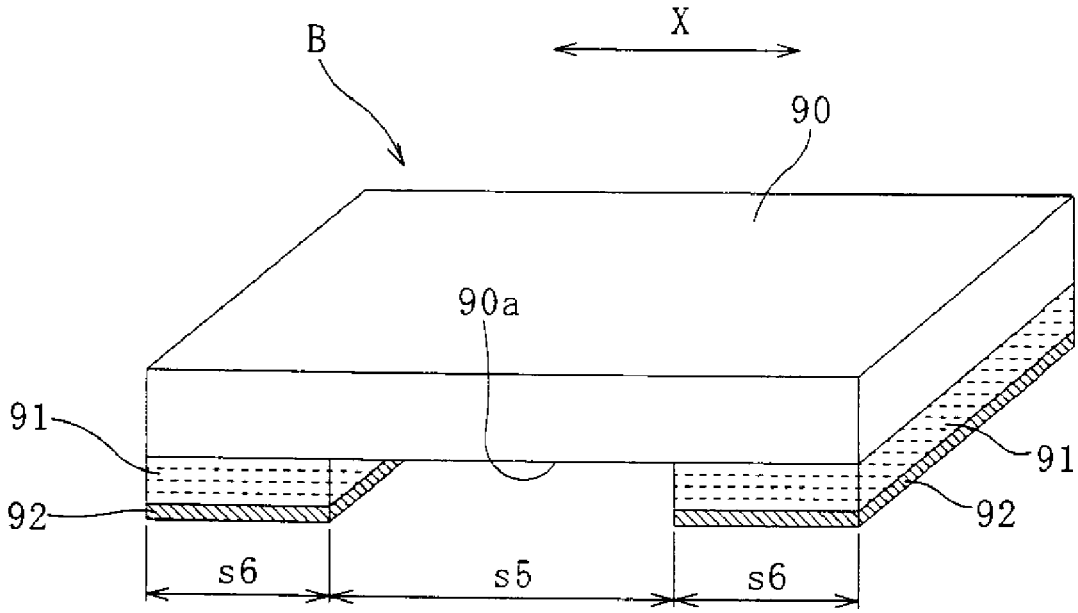
FIG. 15 PRIOR ART
FIG. 15 is a perspective view showing a conventional chip resistor.

FIGS. 14A and 14B show a chip resistor A3 according to a third embodiment of the present invention. As shown in FIG. 14B, the chip resistor A3 is provided with four electrodes 32B on a bottom surface 1*a* of a resistor element 1. These electrodes 32B are formed by first forming a cross-shaped insulation layer 21A on the bottom surface 1*a* of the resistor element 1 and then plating the bottom surface 1*a*. Thereafter, by forming a second insulation layer 218, the chip resistor A3 is obtained. It should be appreciated that the figure does not show plated layers which is formed to facilitate soldering, for convenience of description.

The chip resistor A3 has four electrodes 32B, and can be utilized in the following way. Supposing that the resistance of the chip resistor A3 is given, two of the four electrodes 32B are used for supplying electric current, and the other two electrodes 32B are used for voltage measurement. The pair of current application electrodes are connected to the circuit so as to allow the electric current to pass, and the pair of voltage measurement electrodes are connected to a voltmeter to measure a voltage drop between the two voltage detection terminals. From the measured voltage value and the known resistance, the value of electric current which passes through the resistor element 1 can be known by using the Ohm's Law.

The present invention is not limited to the embodiments described above. The design of a chip resistor according to the present invention may be varied in many ways. For example, the lower electrodes 31 in the first embodiment may have a single-layer structure formed by printing a metal paste and then baking the paste.

In the first embodiment, both of the lower electrodes 31 overlap the insulation film 21. However, only one of the paired electrodes 31 may overlap the insulation film 21. Likewise, in the second embodiment, the second insulation layer 21B is formed to overlap both of the lower electrodes 32. Alternatively, the layer may overlap only one of the electrodes.

In each of the chip resistor manufacturing methods described above, use of the frame may be replaced by use of a plate-like member. In this instance, the insulation films (21, 22) are formed on one of the surfaces and on the other of the surfaces of the plate-like member respectively, and then the plate-like member is divided into a plurality of bars. After the division, the remaining steps such as formation of the insulation film (23) on the side surfaces of each bar may be performed to produce desired chip resistors. Instead of dividing a large plate-like member, a chip resistor may be produced by starting with preparing a small bar-like member, followed by an appropriate process.

The invention claimed is:

1. A method of making a chip resistor, the method comprising the steps of:

patterning a first insulation film on a surface of a metal resistor element, the metal resistor element being thicker than any other element of the chip resistor to serve as a sole supporting substrate on which any other element of the chip resistor is formed;

after patterning the first insulation film on the surface of the metal resistor element, forming a conductive layer on a region of said surface of the resistor element in which the first insulation film is not present;

after forming the conductive layer on the region of said surface of the resistor element in which the first insulation film is not present, patterning a second insulation film on said surface of the resistor element so that the second film extends on both the first insulation film and the conductive layer; and dividing the resistor element into a plurality of chips so that part of the conductive layer is formed into a pair of electrodes spaced from each other via part of the first insulation film.

2. The method according to claim 1, wherein the patterning of the first insulation film and the second insulation film is performed by thick-film printing.

3. The method according to claim 1, wherein the conductive layer is formed by plating.

4. A chip resistor comprising:

a chip-like resistor element serving as a sole supporting substrate on which any other element of the chip resistor is formed, the resistor element including a bottom surface, an upper surface opposite to the bottom surface, two end surfaces and two side surfaces;

a plurality of electrodes spaced from each other on the bottom surface of the resistor element; and an insulator between the electrodes;

wherein the insulator includes a first portion between the electrodes, and a second portion formed integral with the first portion and laminated over at least one of the electrodes at a position away from the bottom surface of the resistor element;

wherein the chip-like resistor element is thicker than any other element of the chip resistor; and wherein a thickness of the insulator at the first portion is greater than a thickness of the insulator at the second portion away from the first portion.

5. The chip resistor according to claim 4, wherein the second portion of the insulator is a flat resin layer as a whole and covers only a part of each electrode, the flat resin layer providing no recess even where the first portion of the insulator is formed.

6. The chip resistor according to claim 4, further comprising a plated layer partially covering each electrode, wherein the combined thickness of the first and second portions of the insulator is smaller than a combined thickness of the electrode and the plated layer.

7. The chip resistor according to claim 5, further comprising an outermost soldering-facilitation layer which covers each end surface of the resistor element and each electrode, the outer soldering-facilitation layer extending in direct contact with the electrode only up to an edge of the flat resin layer without extending onto a flat surface of the flat resin layer.

8. The chip resistor according to claim 4, further comprising an additional insulation film formed on the upper surface of the resistor element, and two auxiliary electrodes spaced from each other via the additional insulation film.

* * * * *